US011858676B2

(12) United States Patent
Chakravarthy et al.

(10) Patent No.: US 11,858,676 B2
(45) Date of Patent: Jan. 2, 2024

(54) SYSTEMS AND METHODS FOR ASSEMBLING UNPACKED MERCHANDISE IN CONTAINERS

(71) Applicant: Walmart Apollo, LLC, Bentonville, AR (US)

(72) Inventors: Sunada S N Chakravarthy, Metuchen, NJ (US); Rei E. Siew Hew Sam, New York, NY (US)

(73) Assignee: WALMART APOLLO, LLC, Bentonville, AR (US)

( * ) Notice: Subject to any disclaimer, the term of this patent is extended or adjusted under 35 U.S.C. 154(b) by 23 days.

(21) Appl. No.: 17/308,689

(22) Filed: May 5, 2021

(65) Prior Publication Data

US 2022/0355963 A1 Nov. 10, 2022

(51) Int. Cl.
*B65B 57/12* (2006.01)
*B65B 59/00* (2006.01)

(52) U.S. Cl.
CPC ..... *B65B 59/001* (2019.05); *B65B 57/12* (2013.01); *B65B 2210/04* (2013.01); *B65B 2220/18* (2013.01)

(58) Field of Classification Search
USPC ..... 53/473
See application file for complete search history.

(56) References Cited

U.S. PATENT DOCUMENTS 4,198,800 A * 4/1980 Wilson ..... B65B 1/06 53/452
9,235,822 B2 1/2016 Tian
9,600,798 B2 3/2017 Battles
9,914,278 B2 3/2018 Pettersson
2018/0117870 A1* 5/2018 Zeilstra ..... B31B 50/006
2018/0215485 A1* 8/2018 Koet ..... B65B 5/12
2021/0103886 A1* 4/2021 Sezaki ..... B65G 1/137

OTHER PUBLICATIONS

Crainic, Teodor G., et al.; "Extreme Point-based Heuristics for Three-Dimensional Bin Packing"; Informs Journal on computing 20, No. 3 (2008); 368-384.
Crainic, Teodor G., et al. .; "Extreme Point-Based Heuristics for Three-Dimensional Bin Packing"; Informs Journal on Computing; Oct. 2007; 1-30.
Elhedhli, Samir, et al. .; "Three-Dimensional Bin Packing and Mixed-Case Palletization"; Informs Journal on Optimization 1, No. 4 (2019); 323-352.

* cited by examiner

*Primary Examiner* — Chinyere J Rushing-Tucker
(74) *Attorney, Agent, or Firm* — Fitch, Even, Tabin & Flannery LLP

(57) ABSTRACT

There are provided systems and methods relating to assembling unpacked merchandise in containers. In one form, the system includes an order of merchandise items to be assembled in containers, and a predetermined set of containers defining different sizes and including at least two different types of containers. The system also includes a control circuit configured to: receive notification of the order, select a first type of container, determine a first subset of the plurality of merchandise items to be received in the selected type of container, select a size of the selected type of container to receive the first subset of merchandise items, and instruct the disposition of the first subset of merchandise items within the selected type and size of container.

17 Claims, 13 Drawing Sheets

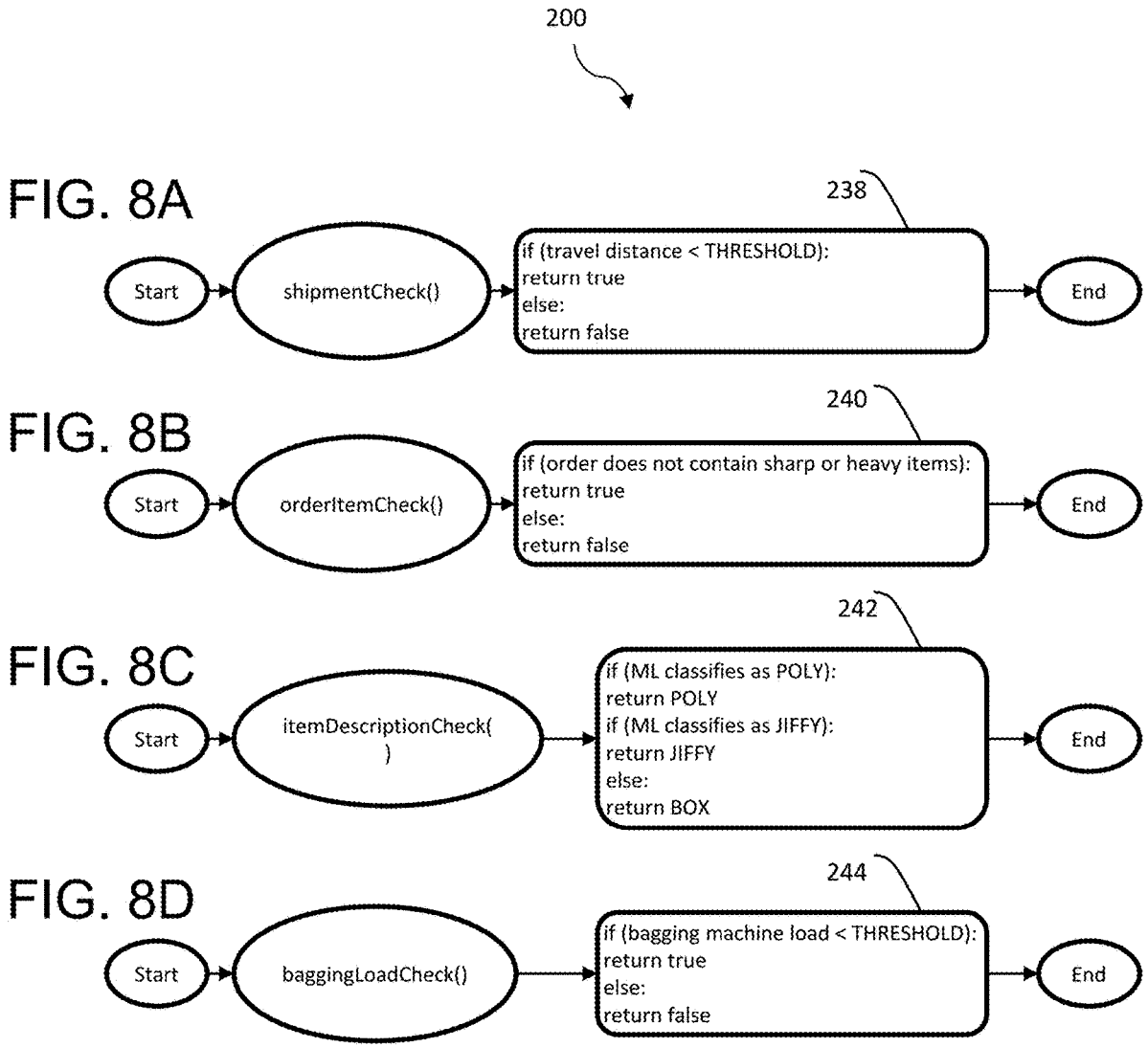
200
FIG. 8A
238
Start
shipmentCheck()
if (travel distance < THRESHOLD):
return true
else:
return false
End
FIG. 8B
240
Start
orderItemCheck()
if (order does not contain sharp or heavy items):
return true
else:
return false
End
FIG. 8C
242
Start
itemDescriptionCheck( )
if (ML classifies as POLY):
return POLY
if (ML classifies as JIFFY):
return JIFFY
else:
return BOX
End
FIG. 8D
244
Start
baggingLoadCheck()
if (bagging machine load < THRESHOLD):
return true
else:
return false
End

SYSTEMS AND METHODS FOR ASSEMBLING UNPACKED MERCHANDISE IN CONTAINERS

TECHNICAL FIELD

This invention relates generally to assembling unpacked merchandise items, and more particularly, to assembling and arranging unpacked merchandise items in containers.

BACKGROUND

In the retail setting, orders are regularly received that are composed of a number of merchandise items. In some circumstances, these orders may include quite a large number of merchandise items. These orders may be received at merchandise distribution centers, or fulfillment centers, where the orders must be assembled and packed in an efficient manner and transported to retail stores or to customers.

There is a need for the assembly and arrangement of these merchandise items in containers in an optimal manner such that the merchandise items are arranged securely and with little wasted space. If these merchandise items are not arranged properly within containers, they may be damaged during transport. Further, because merchandise distribution centers may handle a large number of orders, it is desirable to determine the packing arrangement of merchandise items in containers as quickly as reasonably possible. In addition, a need exists to optimize the selection and use of containers and to select containers that provide an appropriate amount of protection for merchandise items that are being transported in the containers.

BRIEF DESCRIPTION OF THE DRAWINGS

Disclosed herein are embodiments of systems, apparatuses and methods for assembling unpacked merchandise items in containers. This description includes drawings, wherein:

FIGS. 8A, 8B, 8C, and 8D are flow diagrams in accordance with some embodiments;

Figure 1:
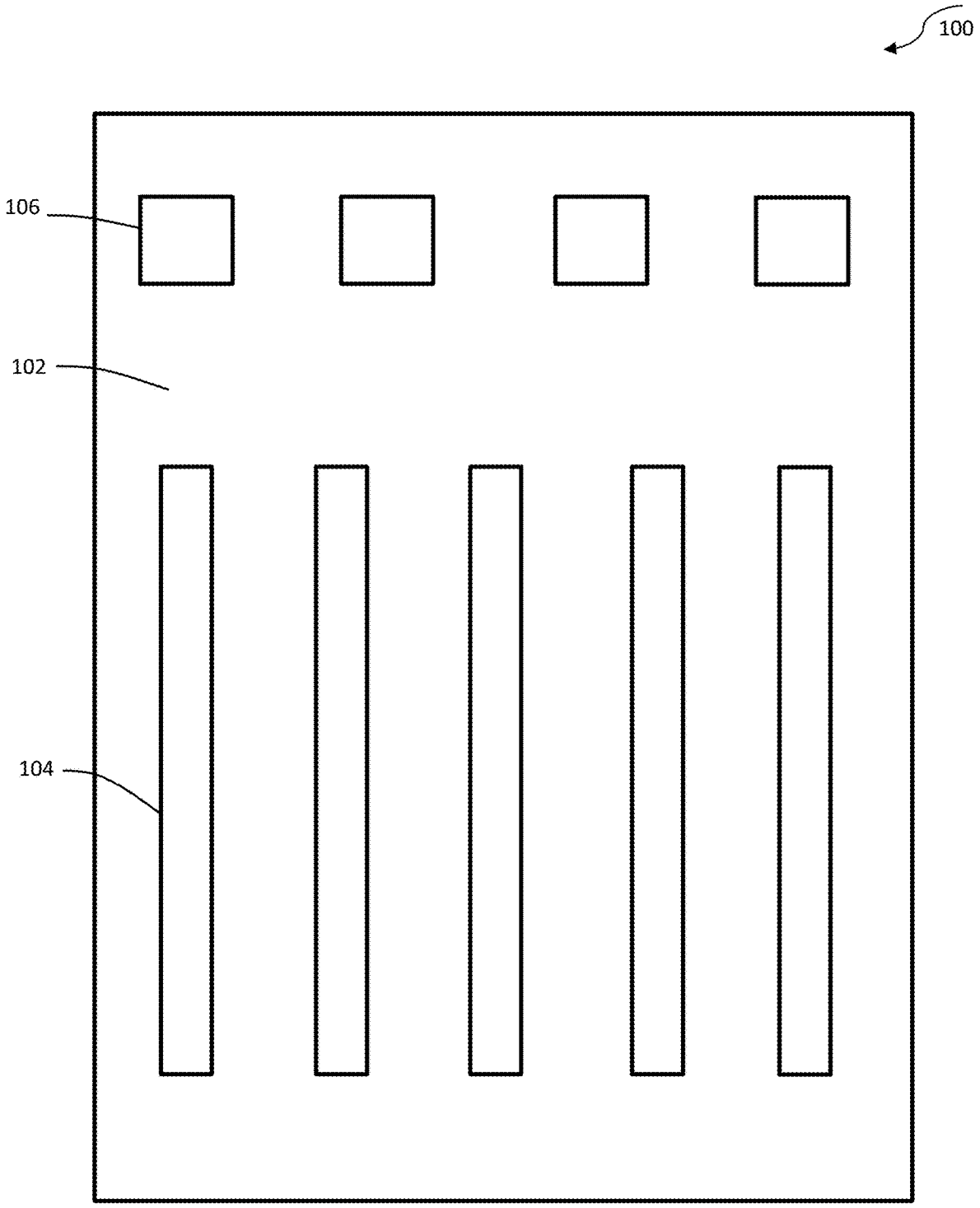
FIG. 1 is a schematic diagram in accordance with some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

The following description is not to be taken in a limiting sense, but is made merely for the purpose of describing the general principles of exemplary embodiments. Reference throughout this specification to "one form," "one embodiment," "an embodiment," "some embodiments", "an implementation", "some implementations", "some applications", or similar language means that a particular feature, structure, or characteristic described in connection with the embodiment is included in at least one embodiment of the present invention. Thus, appearances of the phrases "in one embodiment," "in an embodiment," "in some embodiments", "in some implementations", and similar language throughout this specification do not all refer to the same embodiment.

Generally speaking, pursuant to various embodiments, systems, apparatuses and methods are provided herein for assembling merchandise orders in containers. In one form, the system includes: an order including a plurality of merchandise items to be assembled in at least one container; and a predetermined set of containers defining different sizes and including at least two different types of containers, a first type of container comprising boxes and a second type of container comprising deformable bags, each of a plurality of types of merchandise items corresponding to one of the at least two different types of containers and corresponding to a level of protection for transport of the type of merchandise item. The system also includes a control circuit configured to: receive notification of the order including the plurality of merchandise items; select a first type of container from the at least two types of containers to receive a first subset of the plurality of merchandise items; determine the first subset of the plurality of merchandise items to be received in the selected type of container, each of the merchandise items in the first subset corresponding to the selected type of container; select a size of the selected type of container to receive the first subset of the plurality of merchandise items; and instruct the disposition of the first subset of the plurality of merchandise items within the selected type and size of container.

In some implementations, in the system, the control circuit is configured to determine an arrangement of the first subset of the plurality of merchandise items within the selected type of container comprising: iteratively applying a best fit decreasing algorithm involving reverse sorting the plurality of merchandise items from a largest volume merchandise item to a smallest volume merchandise item; iteratively calculating a plurality of virtual packing arrangements based on the algorithm, the virtual packing arrangements being applied to the selected type of container in order of increasing size; and selecting the arrangement in which the first subset of the plurality of items occupies a selected type of container with the smallest size. In some implementations, the control circuit is configured to: select a second type of container from the at least two types of containers to receive a second subset of the plurality of merchandise items; determine the second subset of the plurality of merchandise items to be received in the second selected type of container, each of the merchandise items in the second subset corresponding to the second selected type of container; select a size of the second selected type of container to receive the second subset of the plurality of merchandise items; and instruct the disposition of the second subset of the plurality of merchandise items within the second selected type and size of container. In some implementations, the control circuit is configured to: receive an input set of flat bags, each flat bag having two dimensions; calculate deformation of each flat bag to generate a set of deformable bags of different volumes for each flat bag, each deformable bag in the set having an associated volume; and select a deformable bag in the set to receive the first subset of the plurality of merchandise items. In some implementations, in the system, the deformable bags comprise at least one of polybags and jiffy bags. In some implementations, the first subset of the plurality of merchandise items are all the same type of merchandise item; and the control circuit is configured to select boxes as the container type and to instruct creation of a customized box that form fits the first subset of the plurality of merchandise items. In some implementations, the control circuit is configured to: receive an indicator that a first merchandise item has a cavity defining a space therein; determine that a second merchandise item has a size that is less than the space defined by the cavity; and instruct that the second merchandise item be disposed within the cavity. In some implementations, the control circuit is configured to: receive an indicator that a merchandise item is to be disposed in protective packaging occupying a predetermined amount of space; calculate a new size of the merchandise item when disposed in the protective packaging; and instruct packing of the protectively packaged merchandise item in a container selected from the predetermined set of containers. In some implementations, the control circuit is configured to: receive an indicator that a merchandise item is to be arranged in a container in a predetermined orientation; calculate a plurality of virtual packing arrangements in which the merchandise item is arranged in the container in the predetermined orientation; and select one of the plurality of the virtual packing arrangements. In some implementations, the control circuit is configured to: cause the display of the arrangement of the first subset of the plurality of merchandise items within the selected type and size of container on a virtual reality framework.

In another form, there is provided a computer implemented method for assembling merchandise orders in containers, the method comprising: receiving notification of an order including a plurality of merchandise items to be assembled in at least one container; receiving input of a predetermined set of containers defining different sizes and including at least two different types of containers, a first type of container comprising boxes and a second type of container comprising deformable bags, each of the plurality of types of merchandise items corresponding to one of the at least two different types of containers and corresponding to a level of protection for transport of the type of merchandise item; selecting a first type of container from the at least two types of containers to receive a first subset of the plurality of merchandise items; determining the first subset of the plurality of merchandise items to be received in the selected type of container, each of the merchandise items in the first subset corresponding to the selected type of container; selecting a size of the selected type of container to receive the first subset of the plurality of merchandise items; and instructing the disposition of the first subset of the plurality of merchandise items within the selected type and size of container.

In another form, there is provided a system for assembling merchandise orders in containers, the system comprising: a control circuit configured to store and execute computer program code to: receive notification of an order including a plurality of selected merchandise items from a customer of a retail entity and to be assembled into at least one container at a merchandise distribution center of the retail entity configured for storage and distribution of a plurality of types of merchandise items; select a first type of container from the at least two types of containers to receive a first subset of the plurality of merchandise items, wherein the merchandise distribution center includes a predetermined set of containers defining different sizes and including at least two different types of containers, the first type of container comprising boxes and a second type of container comprising deformable bags, each of the plurality of types of merchandise items corresponding to one of the at least two different types of containers and corresponding to a level of protection for transport of the type of merchandise item; determine the first subset of the plurality of merchandise items to be received in the selected type of container, each of the merchandise items in the first subset corresponding to the selected type of container; select a size of the selected type of container to receive the first subset of the plurality of merchandise items; and instruct the disposition of the first subset of the plurality of merchandise items within the selected type and size of container.

As an overview, this disclosure is directed generally to assembling unpacked merchandise items in containers in an efficient manner. Fulfillment centers will often receive numerous orders of merchandise over a certain period of time, and some of these orders may include a large number of merchandise. As examples, these orders may be in the form of direct orders from consumers or they may be in the form of orders from retail stores. These orders are often time sensitive and must be filled by a certain due date. Further, these materials may require the use of a number of containers (and possibly different types of containers), and it is desirable to avoid the wasteful use of unnecessary containers.

In one aspect, this disclosure involves the use of an iterative process for determining desirable packing solutions. In some forms, it involves selecting the optimal sizes of containers to pack an order that may be based upon both shipping and corrugate costs. The approach may involve selecting between various types of containers (such as boxes or deformable bags) and various sizes of containers. The selection of the type of container may be based on such factors as the nature of the merchandise items and the desired degree of protection for these items, cost of the containers, etc. Further, the selection may be based on the availability of the types of containers and the operability of boxing or bagging stations.

The approach may also involve the creation of a container (such as a box) of a special size to accommodate the size of the merchandise items in a certain order. The system may save on cost by reducing container sizes and by quickly solving and selecting the container size for a given set of products/merchandise items. The approach is highly scalable and can handle a large assortment of container sizes.

In addition, this disclosure involves a number of areas that allow for more advanced and efficient packing techniques. As a first example, it may take into account item preparation. Fragile items may need to be wrapped in some form of protective packaging before being boxed/bagged, and the system may allow for the dimensions of the protective packaging to be added to the item's dimensions. As a second example, it may take into account nesting of items. The system may allow items to be nested within each other in a container, such as, for instance, an order containing multiple trash cans. As a third example, the system may take into account cavity filling. Merchandise items having cavities may present an opportunity for other items to be used to fill the cavities. As a fourth example, the system may also determine how best to split an order into multiple containers to save on shipping costs and corrugate.

This disclosure addresses a system 100 for assembling merchandise orders in containers, such as at merchandise distribution centers. The system 100 involves assembling unpacked merchandise items in either or both of two types of containers (boxes or deformable bags) depending on the nature of merchandise and may further involve determining an arrangement of merchandise in the containers. This assembly and arrangement generally involves efficient packing and arrangement of products/merchandise items in containers. It is generally desirable to minimize (or eliminate) the number of containers or reduce the size of containers and to determine the packing arrangement quickly.

Referring to FIG. 1, there is shown a schematic diagram of a merchandise distribution center 102. The merchandise distribution center 102 is configured for storage and distribution of a plurality of types of merchandise items. In this example, the merchandise distribution center 102 includes a number of shelves or aisles 104 for the storage of products. In one form, the merchandise distribution center 102 may be operated by a retailer for the purpose of holding merchandise that may, in turn, be transported to multiple stores. Alternatively, it may be operated as a fulfillment center for the delivery of online orders to customers. Also, a retail store may be used as a merchandise distribution center to assemble and/or hold orders of merchandise, such as for home delivery to customers or pick up by customers. As should be evident, a variety of possible types and arrangements of merchandise distribution centers is contemplated.

In this example, the merchandise distribution center 102 includes one or more merchandise order assembly areas 106 (or /work stations). The merchandise order assembly area 106 is configured for assembly of part or all of a merchandise order. In one form, it is generally contemplated that the order may be assembled and shipped out, such as directly to customers or to retail stores. In another form, it is contemplated that the order may be made available for pick up.

Figure 2:
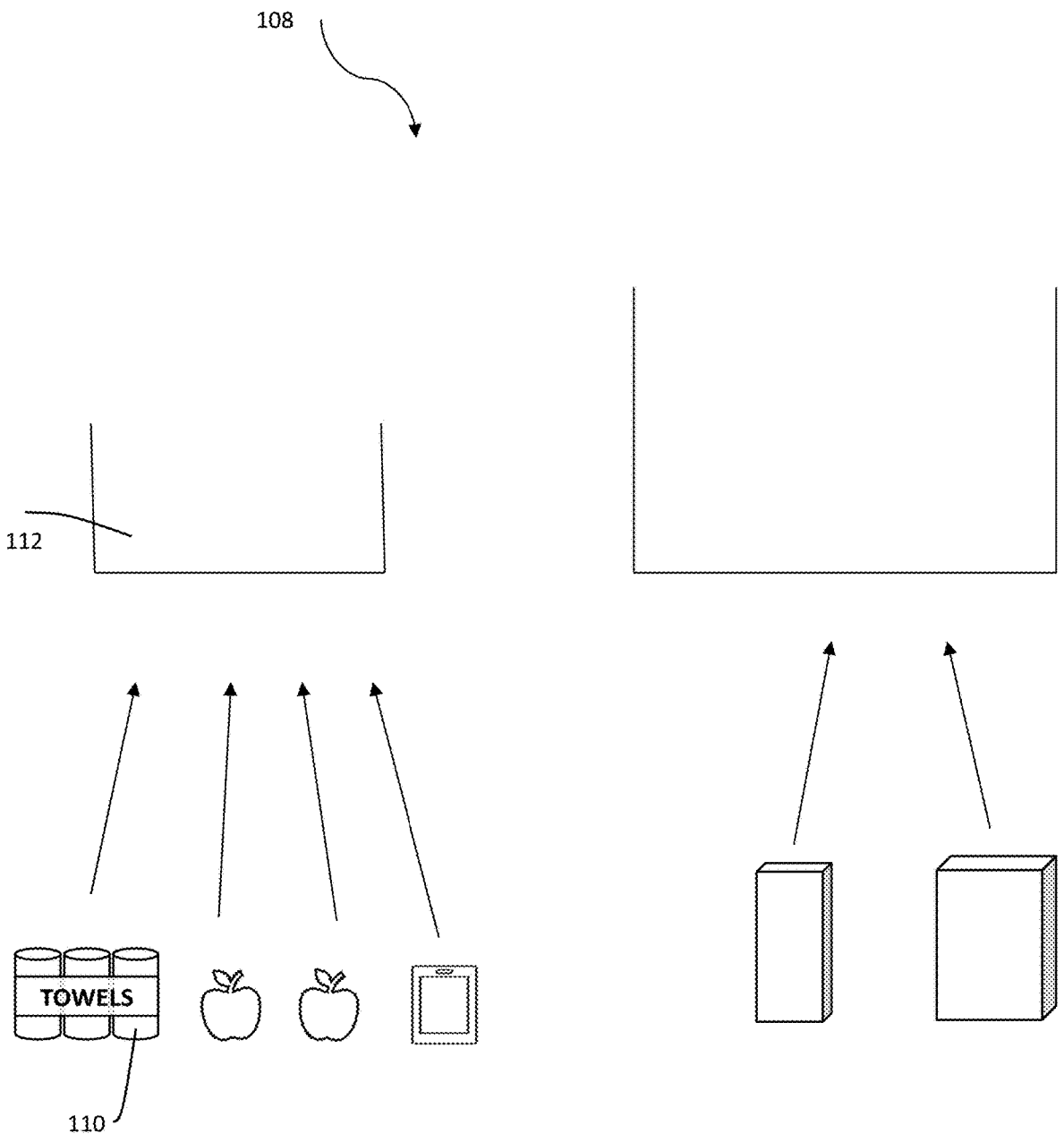
FIG. 2 is a schematic diagram in accordance with some embodiments.

As shown in FIG. 2, the system 100 includes an order 108 including a plurality of merchandise items 110 to be assembled in at least one container 112. The assembly areas 106 may be used to assemble the orders in various types and sizes of containers, such as boxes and/or deformable bags. It is generally contemplated that any and various types of merchandise may be allocated to various containers, such as, without limitation, grocery merchandise, apparel, etc.

Figure 3:
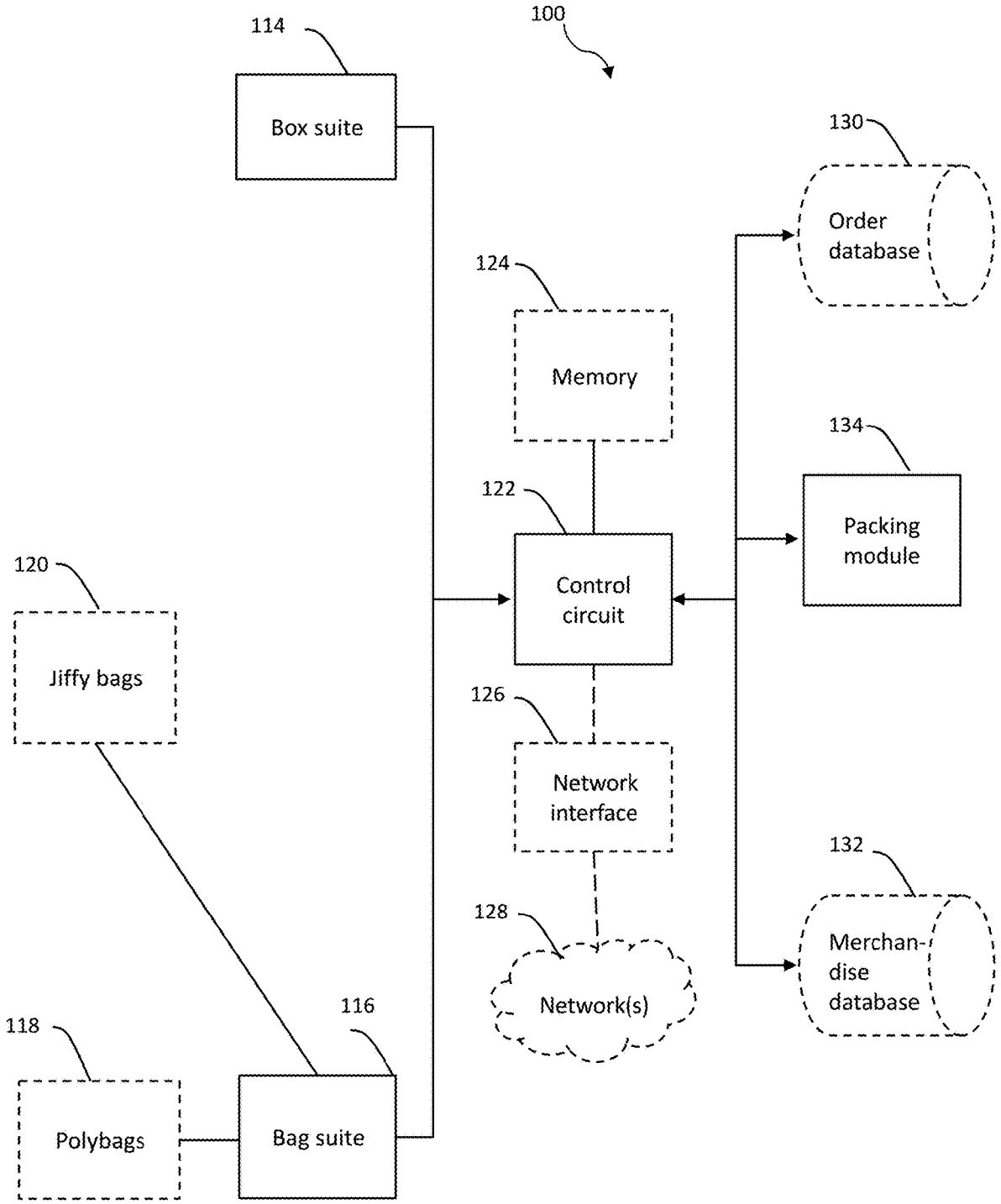
FIG. 3 is a block diagram in accordance with some embodiments.

Referring to FIG. 3, the system 100 also includes a predetermined set of containers defining different sizes and including at least two different types of containers. These types of containers include a first type of container comprising boxes and a second type of container comprising deformable bags. Each of the plurality of types of merchandise items correspond to one of the at least two different types of containers and correspond to a level of protection for transport of the type of merchandise item.

The system 100 includes a box suite 114 with a number of potential different sizes of boxes and a bag suite 116 with a number of potential different sizes of deformable bags. The box suite 114 may be a list of possible boxes in which the order can be packed. Generally, the more sizes that are available, the better one can pack the order, especially when there is a large assortment of merchandise types (stock keeping units or SKUs) of various sizes. Generally, it may be desirable to use deformable bags, where possible, based on factors such as cost and ease of use. However, boxes may offer a higher level of protection that may be desirable for certain more fragile types of merchandise.

In another aspect, the box suite 114 and bag suite 116 may provide an alternative suite of containers in the event that the other suite of containers becomes unavailable or impracticable. For example, the merchandise distribution center 102 may include a number of assembly stations 106. Some of these assembly stations 106 may be boxing stations that may experience problems, such as, for example, technical issues, an overwhelming number of orders, unavailability of many sizes of boxes, etc. In this instance, it may be desirable to switch primarily or exclusively to the bagging stations for a certain period of time.

In one form, the system 100 may utilize deformable bags in the form of polybags 118, and the system 100 may pack certain types of merchandise into polybags 118. This type of deformable bag may provide a lower level of protection that may be desirable for certain types of merchandise. In another form, the system 100 may utilize deformable bags in the form of jiffy bags or envelopes 120, which may also be intended to receive certain types of merchandise. This type of deformable bag may provide an intermediate level of protection between boxes and polybags 118.

The system 100 also includes a control circuit 122 that governs the operation of the system 100. As described herein, the language "control circuit" refers broadly to any microcontroller, computer, or processor-based device with processor, memory, and programmable input/output peripherals, which is generally designed to govern the operation of other components and devices. It is further understood to include common accompanying accessory devices, including memory, transceivers for communication with other components and devices, etc. These architectural options are well known and understood in the art and require no further description here. The control circuit 122 may be configured (for example, by using corresponding programming stored in a memory as will be well understood by those skilled in the art) to carry out one or more of the steps, actions, and/or functions described herein.

As shown in FIG. 3, the control circuit 122 is coupled to a memory 124 and to a network interface 126 and wireless network(s) 128. The memory 124 can, for example, store non-transitorily computer instructions that cause the control circuit 122 to operate as described herein, when the instructions are executed, as is well known in the art. Further, the network interface 126 may enable the control circuit 122 to communicate with other elements (both internal and external to the system 100). This network interface 126 is well understood in the art. The network interface 126 can communicatively couple the control circuit 122 to the wireless network 128 and whatever other networks 128 may be appropriate for the circumstances. The control circuit 122 may form part of, be coupled to, or in communication with a server of the merchandise distribution center 102 and may make use of cloud databases and/or operate in conjunction with a cloud computing platform.

Further, it is generally contemplated that the control circuit 122 may be coupled and may access one or more databases. In this particular example, it may optionally be coupled to two databases, although one or more of these databases may be combined or additional databases may be accessible. In this example, the control circuit 122 may access an order database 130, which may include information relating to current or projected orders. For instance, the order database 130 may include a list of the merchandise in each order, order dates, shipment information, etc. The order database 130 may include various types of orders, such as online orders from customers, orders corresponding to shipments to retail stores, orders for pick up, etc. In this example, the control circuit 122 may also access a merchandise database 132, which may include various characteristics of various types of merchandise. For instance, the merchandise database 132 may include fields showing dimensions of each merchandise item, the desired protection level of each item corresponding to a type of container, protective packaging, nesting and cavity information, shipment orientation of the item, splitting of item into multiple containers, etc.

The control circuit 122 receives notification of the order 108 including the plurality of merchandise items. For example, in one form, the control circuit 122 may access an order database 130 that identifies the merchandise items corresponding to each order. The merchandise items in the order 108 are to be assembled and packed in containers. It is generally contemplated that the order may be of various sizes, i.e., it may include a large number of merchandise items requiring multiple containers or it may include a small number of merchandise items (possibly just one) suitable for one container.

The control circuit 122 selects a first type of container from the at least two types of containers to receive a first subset of the plurality of merchandise items. It is generally contemplated that this "subset" of merchandise items may include one item, some of the items, or all of the items. In one form, it is also contemplated that each of the merchandise items have been pre-assigned to a specific type of container, depending on the level of protection desired. For example, in one form, the control circuit 122 may access a merchandise database 132 that includes the assignment of each type of merchandise item to a specific container type. There may be an assignment of each merchandise type to a specific type of container or an indication that multiple container types are suitable.

The control circuit 122 determines the first subset of the plurality of merchandise items to be received in the selected type of container with each of the merchandise items in the first subset corresponding to the selected type of container. In one form, the control circuit 122 includes or may be communicatively coupled to a packing module 134. It is generally contemplated that this packing module 134 includes one or more algorithms that may be used to iteratively determine a number of possible packing arrangements from which a packing solution is selected.

In one form, the control circuit 122 performs an iterative routine to optimize packing and apply a packing algorithm to efficiently pack the containers. For example, the control circuit 122 iteratively applies a best fit decreasing algorithm involving reverse sorting the plurality of merchandise items from a largest volume merchandise item to a smallest volume merchandise item. The control circuit 122 iteratively calculates a plurality of virtual packing arrangements based on the algorithm, the virtual packing arrangements being applied to the selected type of container in order of increasing size. The control circuit 122 selects the arrangement in which the first subset of the plurality of items occupies a selected type of container with the smallest size. The order can be packed into the most form fitting container(s).

Figure 4A:
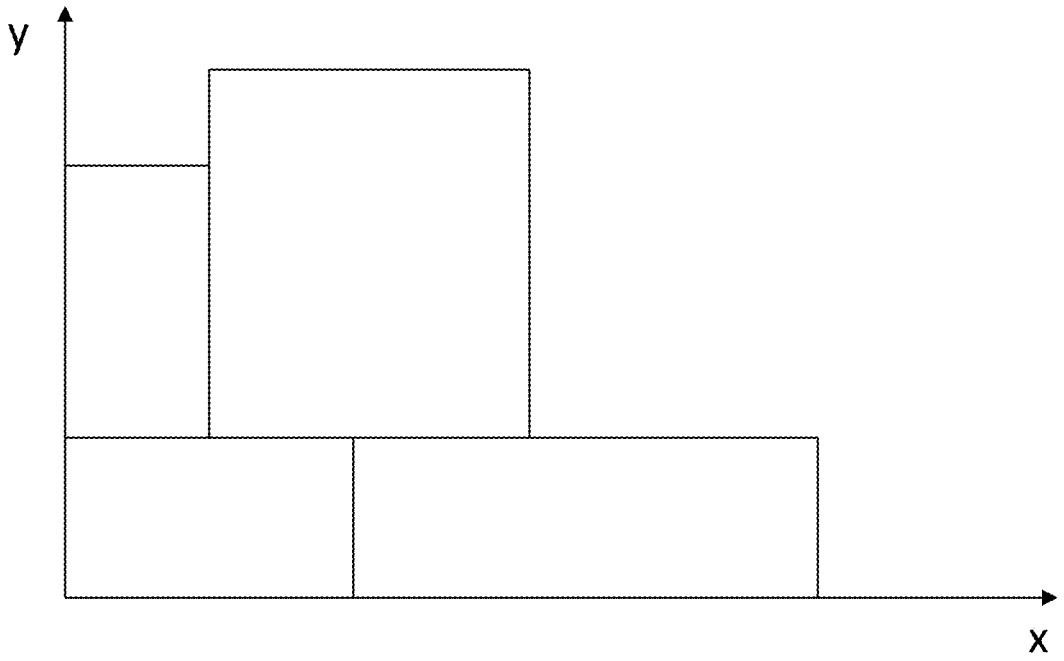
FIGS. 4A and 4B are schematic diagrams in accordance with some embodiments.
Figure 4B:
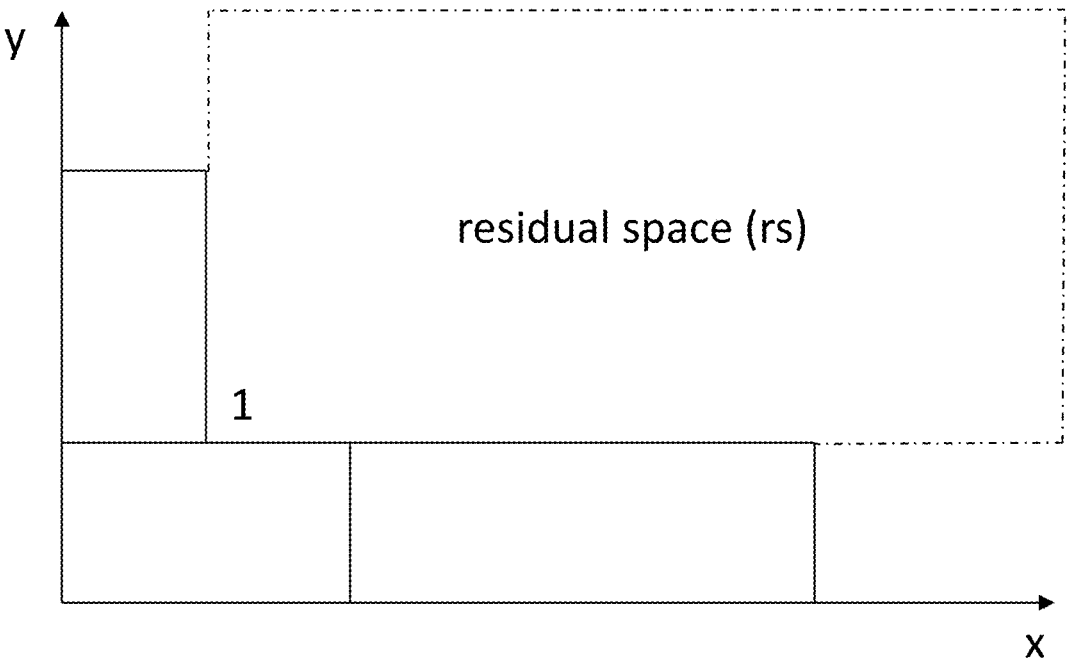

For example, a packing algorithm, such as a type of extreme points heuristic algorithm, may be used, although other packing algorithms are also available. In some forms, this type of algorithm is an extension of a best fit decreasing algorithm/heuristic of sorting the items from largest to smallest volume. Extreme points algorithms help define the contour of free space within the container based on items already inside the container. FIG. 4A shows an example of some packed items having extreme points. Each item generates six extreme points and these are obtained by orthogonal projection of the points onto the nearest surface (item or box). Each extreme point generates residual space as shown in FIG. 4B (extreme point is shown at "1"). The next item in the box is placed at one of the extreme points. One salient example of an article describing some extreme points algorithms is Crainic et al., *Extreme Point-based Heuristics for Three-Dimensional Bin Packing*, CIRRELT-2007-41 (October 2007), the contents of which are incorporated herein by reference in their entirety.

These extreme points heuristic algorithms generally create a large set of possible points of packing by projecting in six different directions, thus resulting in tight packing solutions. Each extreme point has an accompanying residual space, which is the dimensions of the largest item that can be accommodated if an item is placed at the given extreme point. These extreme points are created every time a new item is placed at an existing extreme point by projecting back towards the general direction origin. These projections continue until they hit another item or the box walls. For each subsequent item that needs to be packed, the packing module 134 tries to pack that item at all existing extreme points at all six rotations. In one form, the packing module 134 avoids generating extreme points that are floating in midair such as by moving generated points to the closest solid surface directly below them.

In one form, each placement may then be scored using an entropy calculation on the resultant residual spaces. Each point has $$\frac{rs_{point}}{\sum rs}$$

contribution to total residual space (where rs is the residual space), and for every item, the above value is computed for different rotations (3D). The following equation is then minimized:

$$\sum_{i=0}^{n}\left(\frac{rs_i}{\sum rs} * \log\frac{rs_i}{\sum rs}\right)$$

It is generally desirable for large and small residual spaces to dominate. It is desirable to have a large residual space for new items, while a small residual space generally indicates that the space is being used well. In other words, a low entropy score means that the placement resulted in both large (desirable for new items) and small (indicates the space was well used) residual spaces. The placement and rotation of the item that yields the lowest entropy score may then be chosen as the point of packing.

The control circuit 122 selects a size of the selected type of container to receive the first subset of the plurality of merchandise items. As addressed above, it is generally contemplated that the smallest or most form-fitting container is selected to accommodate the first subset of items. This selection of container size may be performed simultaneously with, in conjunction with, or as part of an iterative process of determining the first subset of items to be received in the selected type of container (and the arrangement therein).

Next, after the container type and size and merchandise disposition have been determined, the control circuit 122 instructs the disposition of the first subset of the plurality of merchandise items within the selected type and size of container. In one form, the instructions may be transmitted to a robot or robotic device that performs the packing. In another form, the instructions may be visually displayed to an individual, who may be conducting the packing, such as at a boxing or bagging workstation 106. In other words, the arrangement of merchandise in a container may be displayed for the packer. For example, the control circuit 122 may cause the display of the arrangement of the first subset of the plurality of merchandise items within the selected type and size of container on a virtual reality framework, which may be run on a traditional browser. The visualization can show the individual how to pack the container, step by step.

In one form, the system 100 can take a mixed order of merchandise and assemble unpacked merchandise into both types of containers—boxes and deformable bags. In other words, the control circuit 122 may be configured to select a second type of container from the at least two types of containers to receive a second subset of the plurality of merchandise items, such as selecting a deformable bag for the second subset while having selected a box for the first subset. It may then proceed using a similar packing approach as for the first subset of merchandise, as addressed above. The control circuit 122 may determine the second subset of the plurality of merchandise items to be received in the second selected type of container, with each of the merchandise items in the second subset corresponding to the second selected type of container. The control circuit 122 may select a size of the second selected type of container to receive the second subset of the plurality of merchandise items. It may instruct the disposition of the second subset of the plurality of merchandise items within the second selected type and size of container. Additionally, in some forms, it may determine the specific arrangement of the second subset of the plurality of merchandise items within the second selected type of container. In some forms, the system 100 provides a highly scalable and fast bin-packing solution that can utilize thousands of box and bag sizes.

In one form, the control circuit 122 can calculate possible deformations in deformable bags to arrive at possible packing dispositions involving deformable bags. In this form, the control circuit 122 receives an input set of flat bags with each flat bag having two dimensions (such as a certain length and width). The control circuit 122 can calculate the deformation of each flat bag to generate a set of deformable bags of different volumes for each flat bag. Each deformable bag in the set will have an associated volume, which can be treated like the empty space of a box for determining the disposition of items therein. Each flat bag can be expanded incrementally to occupy different volumes, and the total of these different volumes defines the set corresponding to each flat bag. The control circuit 122 selects a deformable bag in the set to receive the first subset of the plurality of merchandise items.

In one form, the control circuit 122 may calculate hundreds of deformations of any given single flat bag and the packing algorithm may attempt to pack to these deformed states. In other words, mini static sized bags may map back to a single flat bag size. Bagging is handled by having a set of flat bags as input, and the control circuit 122 calculates the possible deformations of each bag to generate a list of bags, i.e., bag suite 116, and each bag's associated volume. One approach is to determine that certain items are disposed within one or more bags of certain sizes. Another approach is to further determine the specific arrangements of the items in the one or more bags.

In one form, it is contemplated that the system 100 utilizes polybags 118. These types of containers provide a lower level of protection than boxes. They may include plastic bags with bubble wrap, and examples of merchandise packed in this type of container may include foldable items or apparel items.

In one form, it is contemplated that the system 100 utilizes jiffy bags 120 (possibly in addition or as an alternative to polybags 118). These types of containers provide an intermediate level of protection between boxes and polybags 118. They may include protective padding and may be assigned to or appropriate for certain types of merchandise.

Figure 5A:
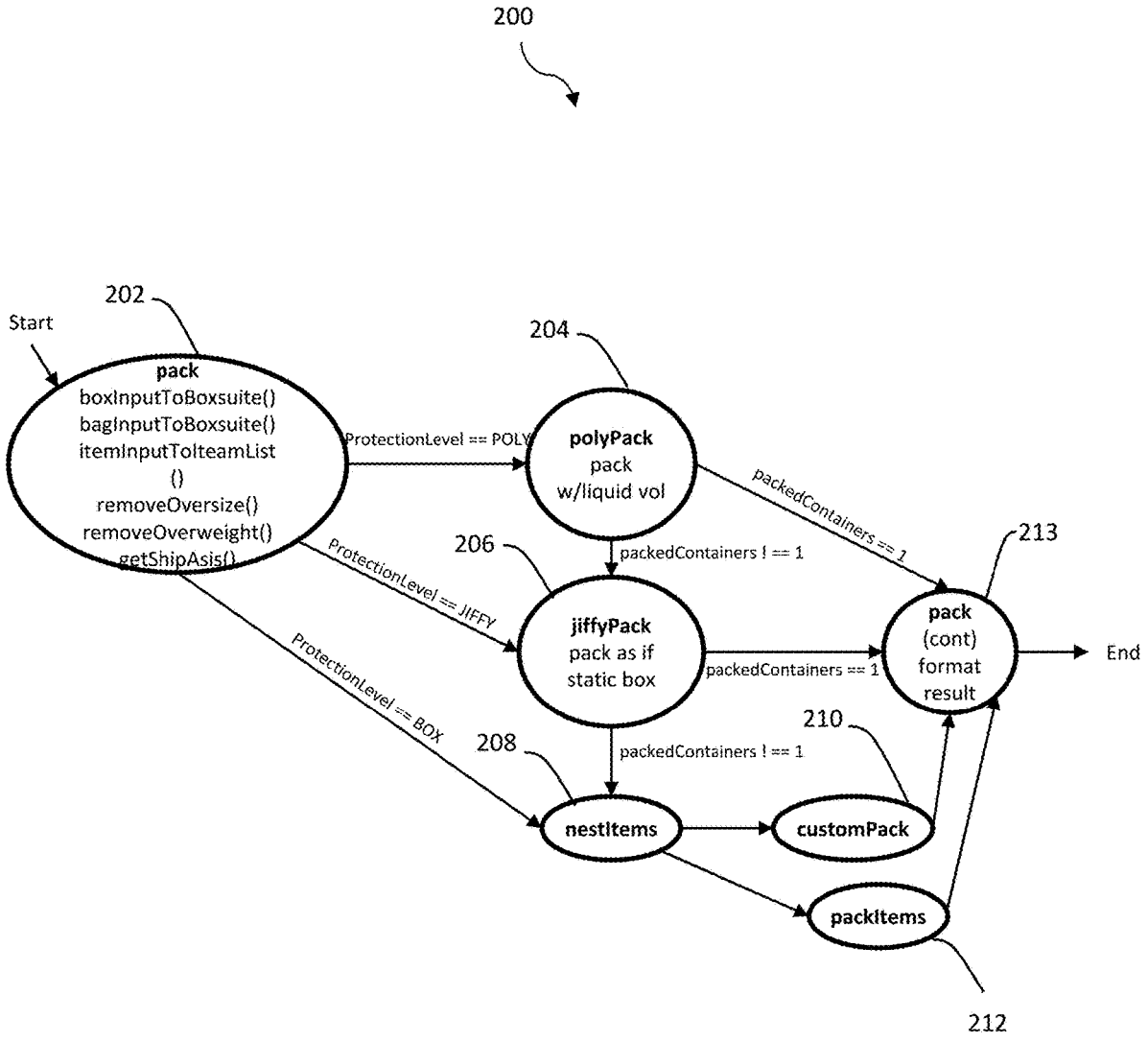
FIGS. 5A and 5B are flow diagrams in accordance with some embodiments.

Referring to FIG. 5A, there is shown a flow diagram of a process 200 for assembling unpacked merchandise items in various types of containers. FIG. 5A shows an example of a main routine for packing items, which, as can be seen, refers to subroutines. At block 202, a determination has been made to pack the merchandise items in a polybag, jiffy bag, and/or box. In some forms, merchandise item(s) may be packed in a polybag or jiffy bag and then packed in a box with other merchandise items. There is a box suite of various possible box sizes.

At block 204, the merchandise item is determined to require a polybag protection level. At this block, the merchandise item is packed based on liquid volume as foldable items. As one example, apparel items and other foldable are items that are flagged for polybags. At block 206, the merchandise item is determined to require a jiffy bag/envelope protection level, which is a step up in protection level from the polybag level. At this block, the merchandise item is packed into static bags/envelopes.

At block 208, the merchandise item is determined to require a box protection level. A determination is made as to whether the merchandise items are all of the same SKU. Some of these types of items are nestable (such as, for example, trash cans) while others are not (such as, for instance, smart phones). If all of the same SKU, the process 200 advances to block 210, and a customized box is created for these types of merchandise. In other words, the box list in the box suit is ignored, and a custom sized box is created that will be form fitted to the merchandise. As an example, an order may be for three smartphones, and the smartphones are arranged so as to minimize surface area. A custom sized box is then created around this arrangement to reduce space. If the order only includes the three smartphones (or is otherwise a small order), it is desirable to create a "best box" specifically for one item or for items of the same SKU.

If the items are not of the same SKU, the process 200 advances to block 212, which is the main routine for packing the items in the box. In one form, the merchandise items are sorted from largest to smallest. For every box that can be considered in the box suite, the box is packed item by item from the largest item to the smallest. If the items do not fit in a particular box size, then the routine proceeds to the next box up in size. If the routine reaches the end of the box list/suite without including every item in any box, then the routine picks the "best box" for a limited number of items, and then repeats the routine with the remaining items. The process 200 then advances to block 213 to continue the packing.

Figure 5B:
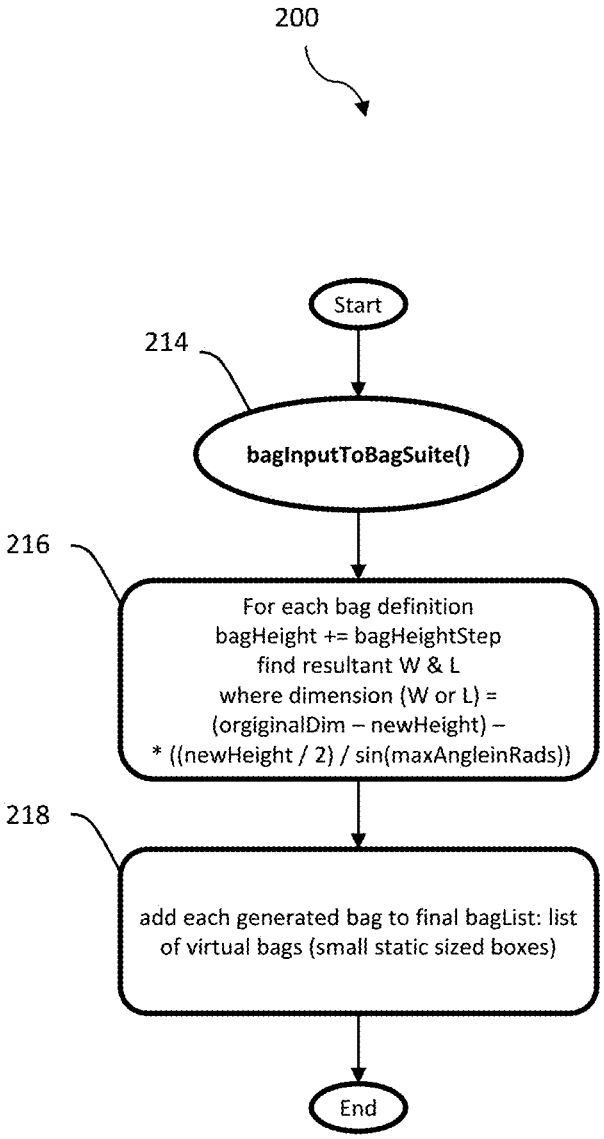

Referring to FIG. 5B, at block 214, a determination has been made to pack the merchandise items in a deformable bag. In one form, the process 200 determines that the merchandise items require a level of protection below that of boxes. The process 200 generates a bag suite of possible bag sizes. At block 216, updated dimensions (width and length) are determined for each incremental deformation (increase in height). For example, at block 216, the process 200 uses the following formula to define new bags within a set: New dimension (W or L)=(original dimension−height)−2*((new height/2)/sin(maximum angle). At block 218, each generated bag is added to the bag list/suite with a corresponding volume that can be utilized in the packing routine or to otherwise determine if merchandise items should be packed in the generated bag.

Figure 6A:
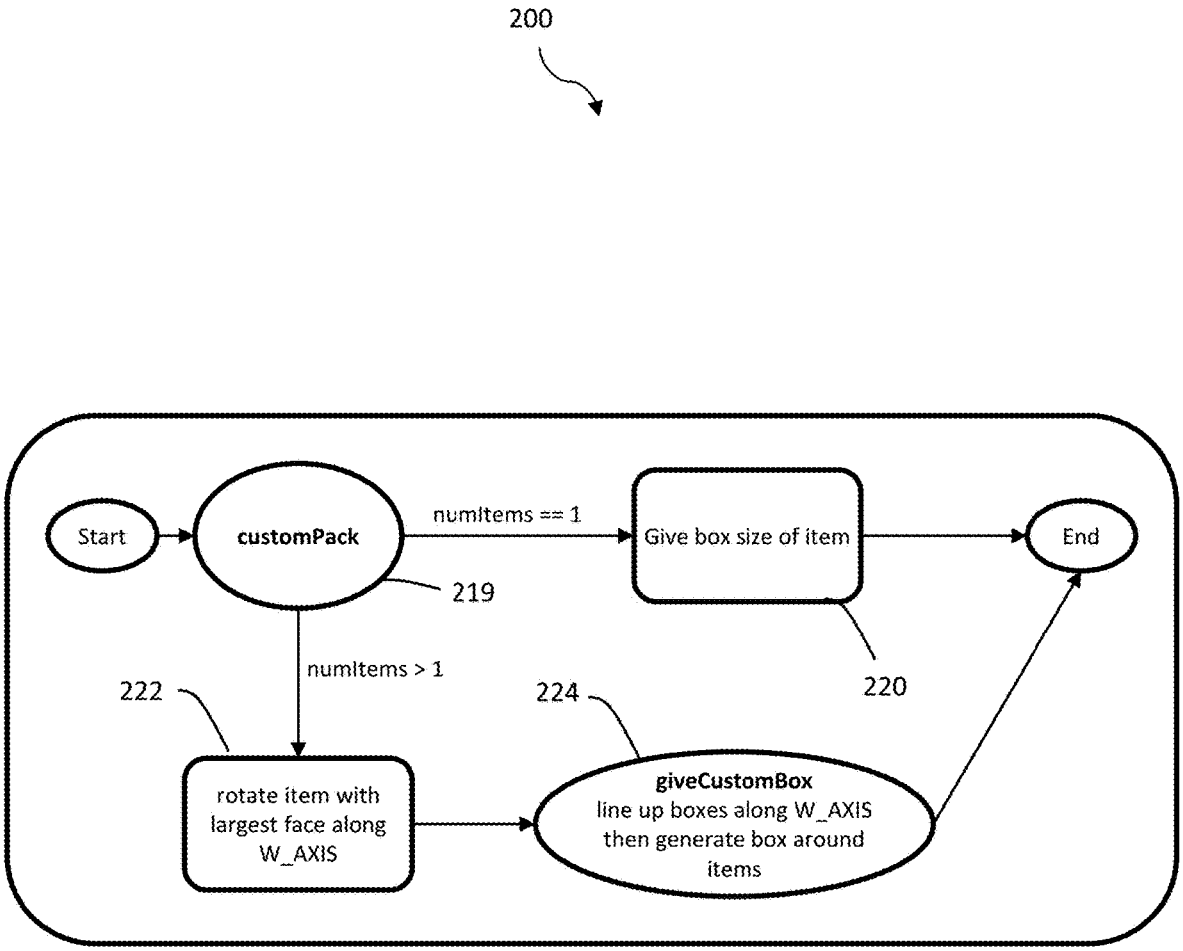
FIGS. 6A, 6B, and 6C are flow diagrams in accordance with some embodiments.

Referring to FIG. 6A, there is shown an example of a subroutine of the customized packing shown at block 210 of the main routine in FIG. 5A. At block 219, the subroutine starts and determines whether there is one item or more than one item. At block 220, if there is one item, the subroutine simply boxes the item based on its known size. At block 222, if there is more than one item, the items are stacked and arranged along an axis. At block 224, the items are lined up along the axis and a customized box is generated around them. In one example, three smartphones are stacked face-to-face along an axis, and a customized box is created around them. As addressed above, it is generally contemplated that this customized packing approach involves one SKU and is suitable for the creation of a customized box. The other features addressed below are generally agnostic as to the use of a box or bag.

Figure 6B:
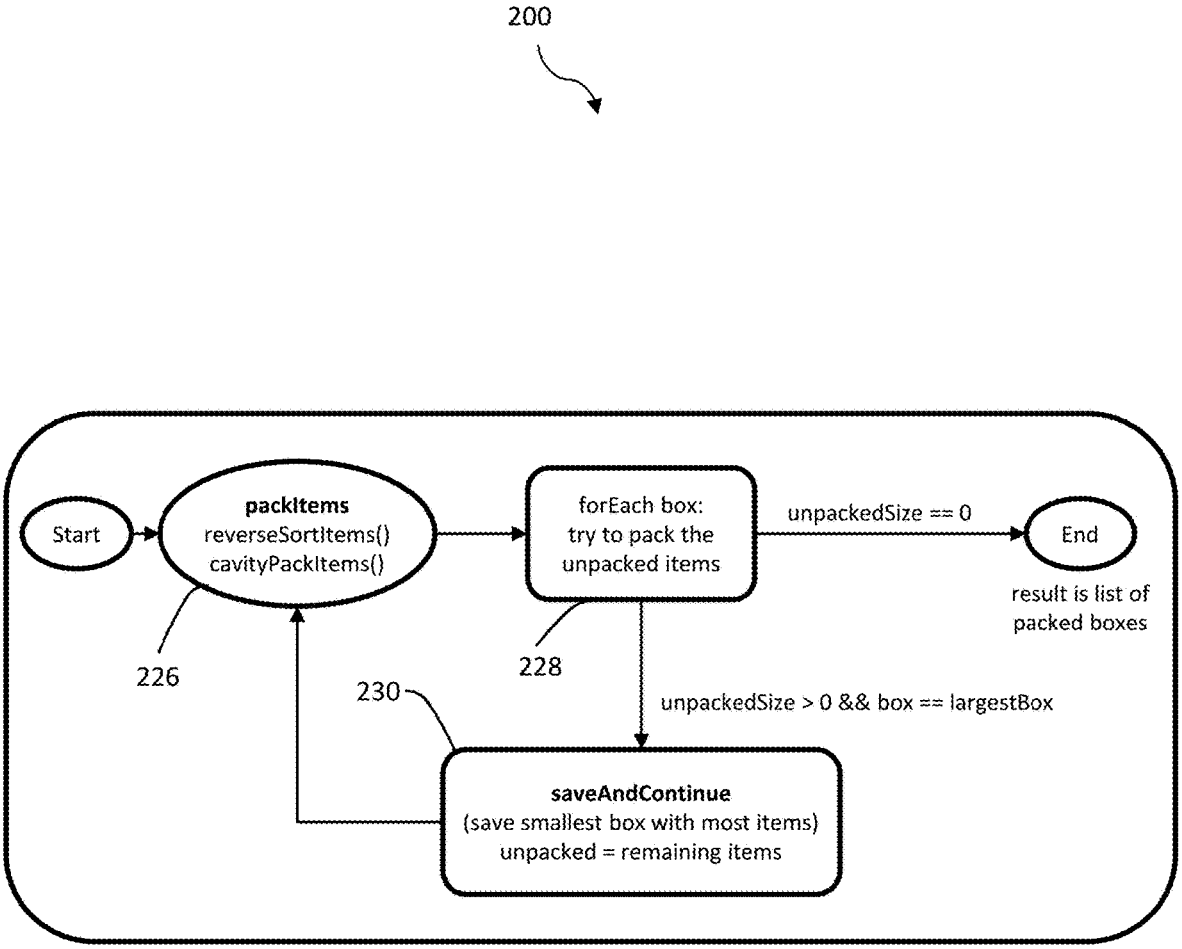

Referring to FIG. 6B, there is shown an example of a subroutine of the default (non-customized) packing shown at block 212 of the main routine in FIG. 5A. At block 226, the subroutine starts with a reverse sorting approach. At block 228, for each container in the box suite or bag suite, the subroutine tries to pack the unpacked items in the container. At block 230, if there remain unpacked items after reaching the largest container, the subroutine will save the iteration having the smallest container containing the most items. The subroutine continues on with the remaining, unpacked items.

Figure 6C:
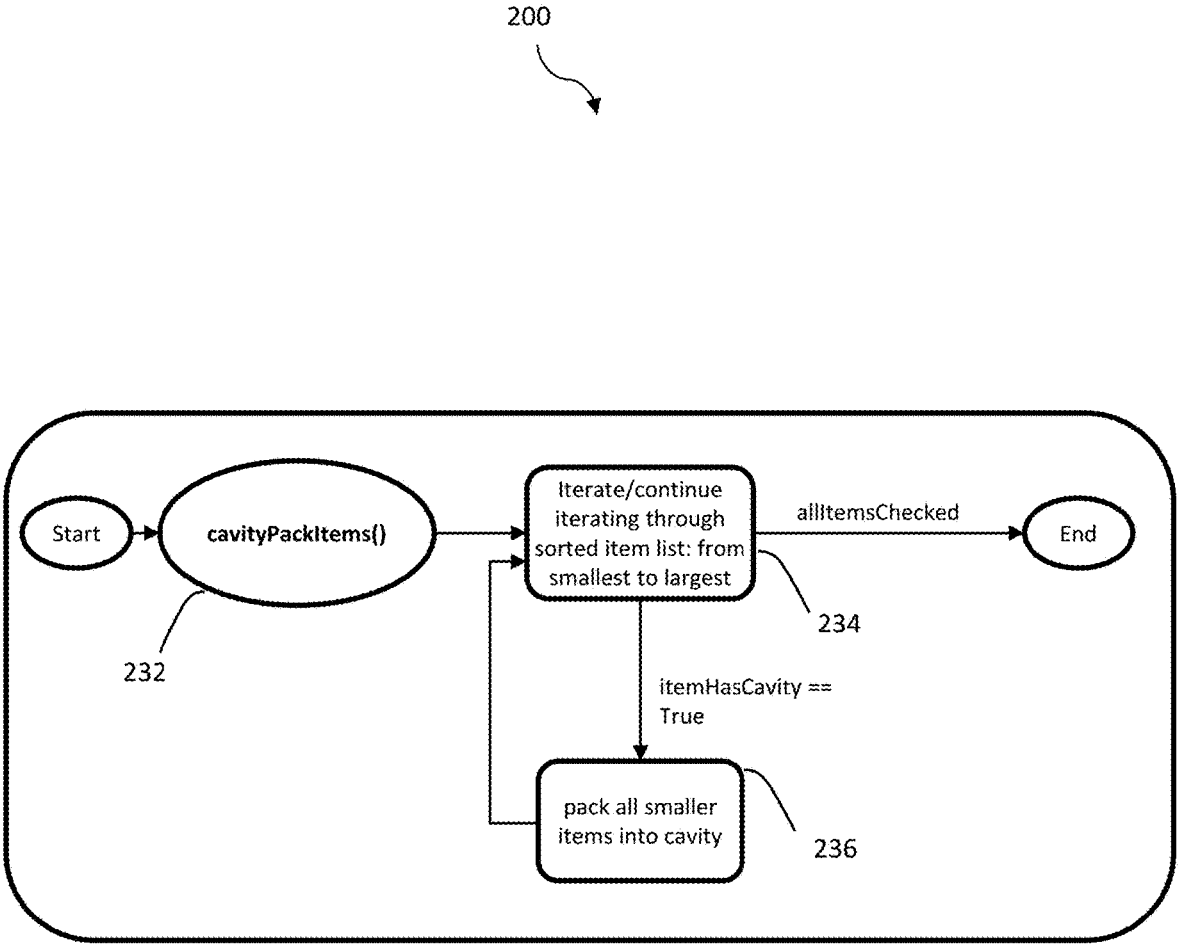

Referring to FIG. 6C, there is shown an example of a subroutine referred to in block 226 in FIG. 6B in which cavities in larger merchandise items are packed with smaller merchandise items. At block 232, the subroutine starts and, at block 234, the subroutine proceeds iteratively through the item list from smallest item to largest item. It determines if there is a flag indicating that an item has a cavity. If yes, at block 236, smaller items are packed into the cavity.

Other features may also be included. For instance, the control circuit 122 may take into account item preparation. Fragile items may need to be wrapped in some form of protective packaging. For types of merchandise flagged as fragile items, an offset may be applied. Offsets may account for bubble wrap/tape wrap/paper wrap that exist for fragile items, and the system can take variable thicknesses of this wrap and account for it during packing. In other words, the system may apply an offset corresponding to the dimensions of the protective packaging, which are added to the item's dimensions. Another feature is to limit the rotation of certain types of merchandise, where it may be important for items that are required to be upright, such as some liquid items. Where flagged as such, certain types of merchandise items may only be oriented in a certain manner when determining possible arrangements within containers.

In one form, another feature is splitting a merchandise item into more than one container, even though it could fit in one container. In other words, for certain types of merchandise items, it may make sense, from a cost perspective, to split the merchandise item between two containers. One example is splitting a popcorn order between two relatively small containers (rather than one large container). The control circuit 122 forces splits upon these sorts of items in order to get better shipping rates. In some cases, such as packing large but light objects into a container, such as popcorn, it is cheaper to split the shipment into smaller containers, rather than having a single light and large container. In this form, shipping rates may be tracked, and the control circuit 122 may perform calculations based on current shipping rates to determine whether and how to split the order.

Figure 7:
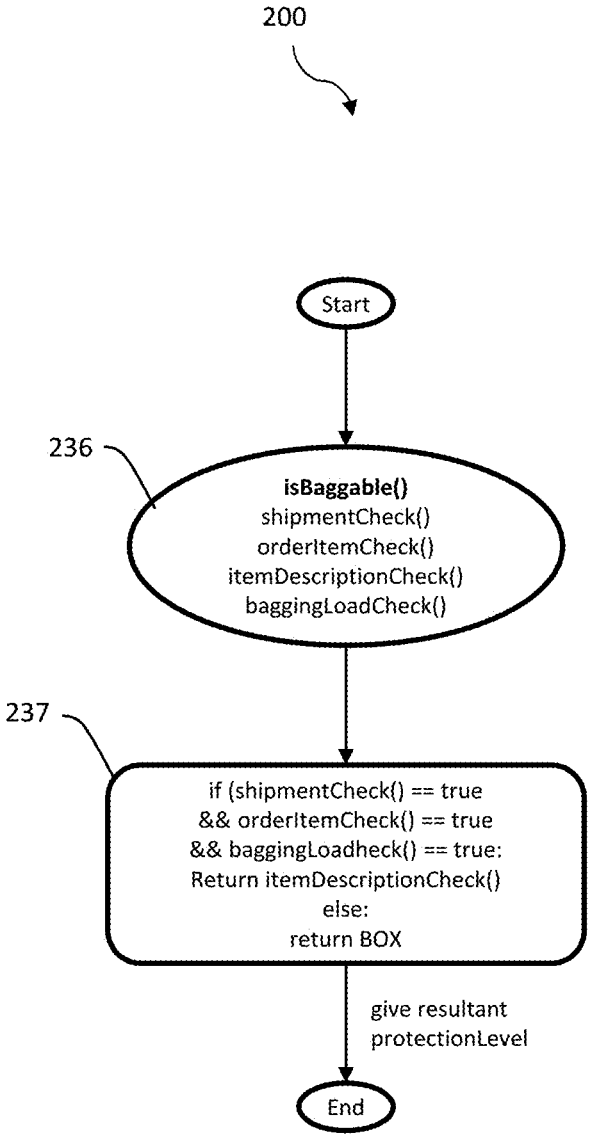
FIG. 7 is a flow diagram in accordance with some embodiments.

Referring to FIGS. 7 and 8A-8D, there is shown an example of a main routine and a series of subroutines that might be used to determine whether a merchandise item should be placed in a polybag or jiffy bag or would need to be boxed. Factors that could be taken into consideration include the description of the item, the other items within the order, and the distance that the order needs to travel in order to be delivered. In the example, as shown in FIG. 7, block 236 calls several different subroutines that all must be true in order to use a bag, and if any are false, a box is used (block 237). At block 238, in FIG. 8A, the subroutine determines if the distance that the order must travel is below a certain threshold. At block 240, in FIG. 8B, certain merchandise items must be boxed, such as, for example, predetermined items that are sharp or heavy (exceed a certain weight threshold). At block 242, in FIG. 8C, some form of machine learning (which may be based, in part, on the item description) may be used to determine the type of container to be used. For example, certain types of merchandise items may be classified into certain categories of containers, which, in turn, may serve as examples for classifying similar types of merchandise items. At block 244, in FIG. 8D, if the bagging machine load is below a certain threshold, then a bag may be used. As should be understood, one or more of these factors, alone or in combination, might be used to determine the container to be used.

Figure 9:
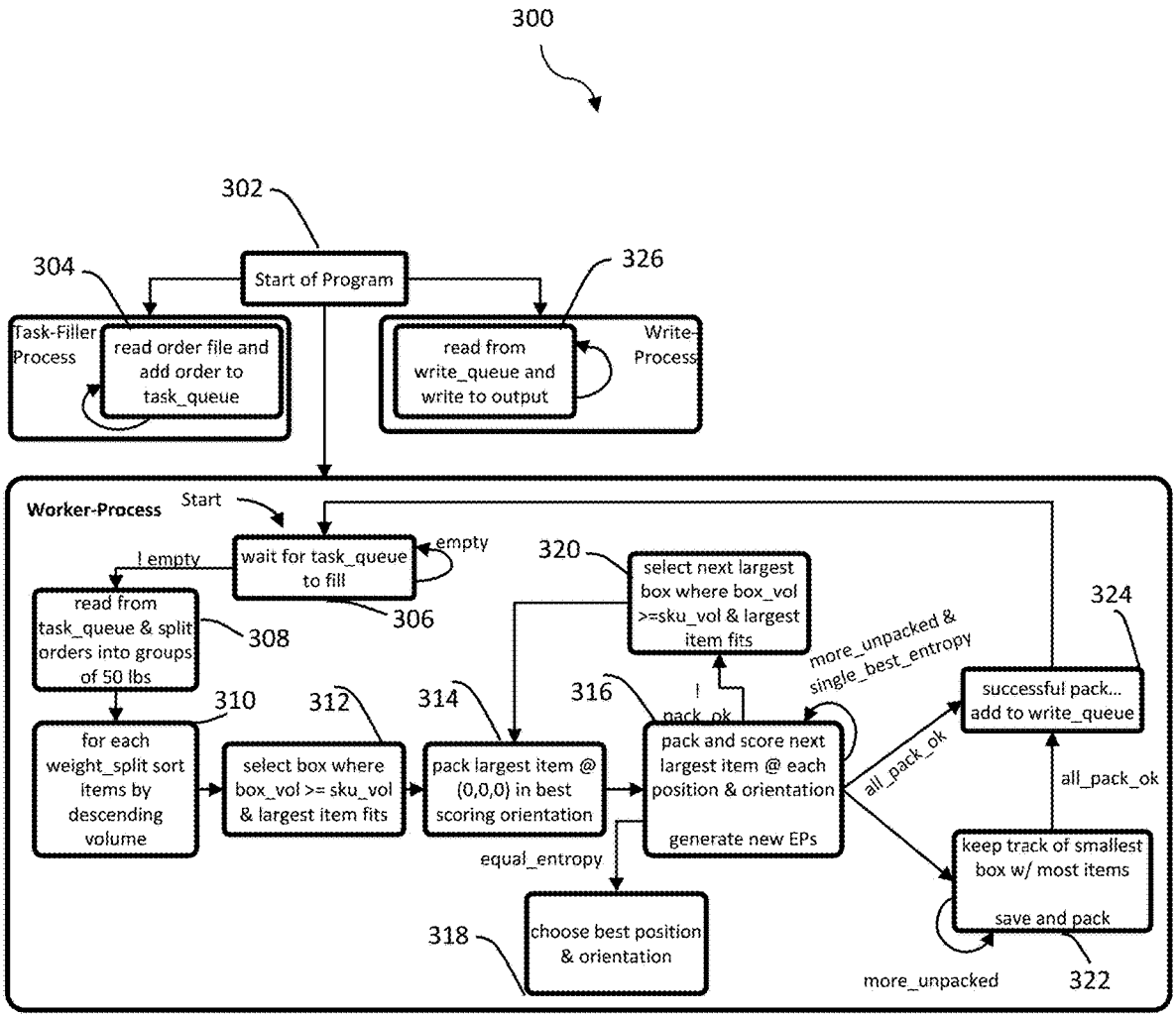
FIG. 9 is a flow diagram in accordance with some embodiments.

In another aspect of this disclosure, FIG. 9 shows a process 300 for coordinating the assembly of unpacked merchandise items between various workers. The process 300 uses three types of workers (some or all of which may be robots or robotic devices): a task queue filler, a writer, and a task worker. The task queue filler takes in raw orders. The task queue filler may also handle certain pre-processing issues, such as nesting and oversized items, and puts each list of items into the work queue. The task worker takes the items form the work queue and attempts to pack them into container(s). In other words, the task worker may take an order, may split the order into multiple containers and cavity packing, and may find the smallest container or least number of containers that can accommodate the order. After an order is packed, it may be sent to the writer. The writer takes the result and writes it either to a file or prints it out to a console or display.

At block 302, the process 300 starts and proceeds along three paths. At block 304, the task queue filler initially handles the orders and adds an order to the task queue. At block 306, the task worker receives the order from the task queue. At block 308, orders are split into subsets (groups of 50 pounds), and then at block 310, the items in each subset are sorted by descending volume (largest item to smallest item). At block 312, for a subset of items, a container is selected where the container volume exceeds the size of the largest item such that the largest item fits. At block 314, the largest item is arranged at an initial position and in the best scoring orientation. At block 316, the next largest items are iteratively packed and scored at each position and orientation and extreme points (EPs) are generated. At block 318, the best position and orientation are chosen based on a packing algorithm. At block 320, the next largest container is selected where the volume exceeds the size of the largest item, and the iterative packing and scoring at blocks 316 and 318 are performed again. This continues with containers of decreasing size. At block 322, the process 300 keeps track of the smallest container with the most items, saves and packs this arrangement, and continues with any remaining unpacked items. At block 324, the process 300 determines that a successful pack has been completed, adds it to the write queue, and proceeds to the next order in the task queue. At block 326, the writer receives the successful pack result and transfers it to an output, such as a file or display.

Figure 10:
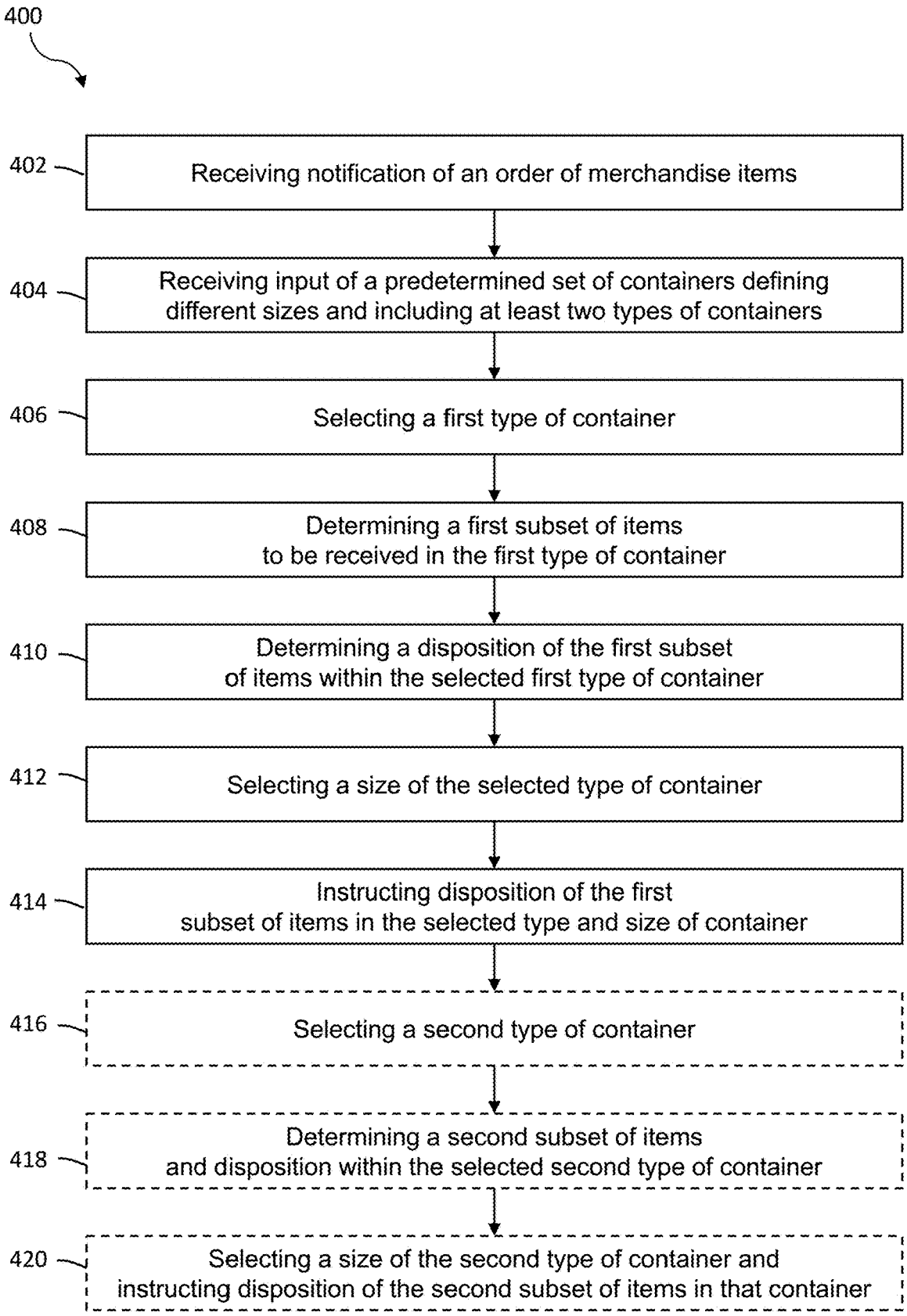
FIG. 10 is a flow diagram in accordance with some embodiments.

Referring to FIG. 10, there is shown a process 400 for assembling unpacked merchandise items in either or both of two types of containers (boxes or deformable bags). This process 400 may incorporate one or more of the elements described above in system 100. Further, this process 400 summarizes and incorporates the processes 200 and 300 described above. As should be understood, these steps do not necessarily occur in the specific order in which they are presented.

At block 402, notification of an order of merchandise items is received. The order may be received and handled individually. Alternatively, the order may be part of an order database or task queue of orders. It is generally contemplated that the order may be received from any variety of sources and in various contexts, such as, for example, an online order placed by a consumer, an order of numerous items for transport to a retail store, or an order made available for pickup at a store.

At block 404, an input of a predetermined set of containers is received. The predetermined set defines different sizes and includes at least two different types of containers with a first type of container comprising boxes (box suite/list) and a second type of container comprising deformable bags (bag suite/list). Each of the types of merchandise items (or SKUs) correspond to one of the at least two different types of containers, which correspond to a level of protection for transport of the type of merchandise item.

At block 406, a first type of container is selected, so, for example, boxes are selected. At block 408, a first subset of items to be received in the first type of container is determined, and at block 410, a disposition of the first subset of items within the selected type of container is determined. In one form, it is contemplated that a specific arrangement is determined and that these steps are performed iteratively to optimize packing and apply a packing algorithm to efficiently pack the containers. In one form, an iterative routine is performed involving reverse sorting the plurality of merchandise items from a largest volume merchandise item to a smallest volume merchandise item. The items may be virtually packed in different arrangements in containers of decreasing size.

At block 412, a container size is selected, such as, for example, a box size. In one form, the box size and arrangement are selected in which the first subset of the plurality of items occupies a selected type of container (box) with the smallest size. The order can be packed into the most form fitting box(es). At block 414, disposition of the first subset of items in the selected type and size of container is instructed. This instruction may be performed in various ways, such as, for example, transmitting a text file with written instructions or transmitting an image file to a VR display.

It is generally contemplated that the process 400 can take a mixed order of merchandise and assemble unpacked merchandise in both types of containers—boxes and deformable bags. At block 416, a second type of container is selected, such as, for example, bags. At block 418, a second subset of items to be received in the second type of container is determined, and in one form, the second subset of items may be disposed in the second type of container in any manner. Optionally, in one form, it is contemplated that a specific arrangement is determined and that a packing algorithm to efficiently pack the containers.

At block 420, a container size is selected, such as, for example, a bag size, and disposition of the second subset of items in that type of container is instructed. In one form, the process 400 may use a bag suite that includes a list of bags of different sizes and associated volumes. The process 400 may use an input set of flat bags with each flat bag having two dimensions (such as a certain length and width), and deformation of each flat bag may be calculated to generate a set of deformable bags of different volumes for each flat bag. Each deformable bag in the set will have an associated volume to be used in determining the disposition of the second subset of items.

Those skilled in the art will recognize that a wide variety of other modifications, alterations, and combinations can also be made with respect to the above-described embodiments without departing from the scope of the invention, and that such modifications, alterations, and combinations are to be viewed as being within the ambit of the inventive concept.

What is claimed is:

1. A system for assembling merchandise orders in containers, the system comprising:

an order including a plurality of merchandise items to be assembled in at least one container;

a predetermined set of containers defining different sizes and including at least two different types of containers, a first type of container comprising boxes and a second type of container comprising deformable bags, each of a plurality of types of merchandise items corresponding to one of the at least two different types of containers and corresponding to a level of protection for transport of the type of merchandise item;

a control circuit configured to:

receive notification of the order including the plurality of merchandise items;

select a first type of container from the at least two types of containers to receive a first subset of the plurality of merchandise items;

determine the first subset of the plurality of merchandise items to be received in the selected type of container, each of the merchandise items in the first subset corresponding to the selected type of container and the corresponding level of protection for transport of the type of merchandise item;

select a size of the selected type of container to receive the first subset of the plurality of merchandise items; and instruct disposition of the first subset of the plurality of merchandise items within the selected type and size of container;

wherein the control circuit is configured to determine an arrangement of the first subset of the plurality of merchandise items within the selected type of container comprising:

iteratively applying a best fit decreasing algorithm involving reverse sorting the plurality of merchandise items from a largest volume merchandise item to a smallest volume merchandise item;

iteratively calculating a plurality of virtual packing arrangements based on the algorithm, the virtual packing arrangements being applied to the selected type of container in order of increasing size; and selecting the arrangement in which the first subset of the plurality of items occupies a selected type of container with a smallest size.

2. The system of claim 1, wherein the control circuit is configured to:

select a second type of container from the at least two types of containers to receive a second subset of the plurality of merchandise items;

determine the second subset of the plurality of merchandise items to be received in the second selected type of container, each of the merchandise items in the second subset corresponding to the second selected type of container;

select a size of the second selected type of container to receive the second subset of the plurality of merchandise items; and instruct the disposition of the second subset of the plurality of merchandise items within the second selected type and size of container.

3. The system of claim 1, wherein:

the first subset of the plurality of merchandise items are all a same type of merchandise item; and the control circuit is configured to select boxes as the container type and to instruct creation of a customized box that form fits the first subset of the plurality of merchandise items.

4. The system of claim 1, where the control circuit is configured to:

receive an indicator that a first merchandise item has a cavity defining a space therein;

determine that a second merchandise item has a size that is less than the space defined by the cavity; and instruct that the second merchandise item be disposed within the cavity.

5. The system of claim 1, wherein the control circuit is configured to:

receive an indicator that a merchandise item is to be disposed in protective packaging occupying a predetermined amount of space;

calculate a new size of the merchandise item when disposed in the protective packaging; and instruct packing of the protectively packaged merchandise item in a container selected from the predetermined set of containers.

6. The system of claim 1, wherein the control circuit is configured to:

receive an indicator that a merchandise item is to be arranged in a container in a predetermined orientation;

calculate a plurality of virtual packing arrangements in which the merchandise item is arranged in the container in the predetermined orientation; and select one of the plurality of the virtual packing arrangements.

7. The system of claim 1, wherein the control circuit is configured to:

cause a display of the arrangement of the first subset of the plurality of merchandise items within the selected type and size of container on a virtual reality framework.

8. A system for assembling merchandise orders in containers, the system comprising:

an order including a plurality of merchandise items to be assembled in at least one container;

a predetermined set of containers defining different sizes and including at least two different types of containers, a first type of container comprising boxes and a second type of container comprising deformable bags, each of a plurality of types of merchandise items corresponding to one of the at least two different types of containers and corresponding to a level of protection for transport of the type of merchandise item;

a control circuit configured to:

receive notification of the order including the plurality of merchandise items;

select a first type of container from the at least two types of containers to receive a first subset of the plurality of merchandise items;

determine the first subset of the plurality of merchandise items to be received in the selected type of container, each of the merchandise items in the first subset corresponding to the selected type of container and the corresponding level of protection for transport of the type of merchandise item;

select a size of the selected type of container to receive the first subset of the plurality of merchandise items; and instruct disposition of the first subset of the plurality of merchandise items within the selected type and size of container;

wherein the control circuit is further configured to:

receive an input set of flat bags, each flat bag having two dimensions;

calculate deformation of each flat bag to generate a set of deformable bags of different volumes for each flat bag, each deformable bag in the set having an associated volume; and select a deformable bag in the set to receive the first subset of the plurality of merchandise items.

9. The system of claim 8, wherein the deformable bags comprise at least one of polybags and jiffy bags.

10. A computer implemented method for assembling merchandise orders in containers, the method comprising:

receiving notification of an order including a plurality of merchandise items to be assembled in at least one container;

receiving input of a predetermined set of containers defining different sizes and including at least two different types of containers, a first type of container comprising boxes and a second type of container comprising deformable bags, each of a plurality of types of merchandise items corresponding to one of the at least two different types of containers and corresponding to a level of protection for transport of the type of merchandise item;

selecting a first type of container from the at least two types of containers to receive a first subset of the plurality of merchandise items;

determining the first subset of the plurality of merchandise items to be received in the selected type of container, each of the merchandise items in the first subset corresponding to the selected type of container and the corresponding level of protection for transport of the type of merchandise item;

selecting a size of the selected type of container to receive the first subset of the plurality of merchandise items;

instructing disposition of the first subset of the plurality of merchandise items within the selected type and size of container; and by a control circuit, determining an arrangement of the first subset of the plurality of merchandise items within the selected type of container comprising:

iteratively applying a best fit decreasing algorithm involving reverse sorting the plurality of merchandise items from a largest volume merchandise item to a smallest volume merchandise item;

iteratively calculating a plurality of virtual packing arrangements based on the algorithm, the virtual packing arrangements being applied to the selected type of container in order of increasing size; and selecting the arrangement in which the first subset of the plurality of items occupies a selected type of container with a smallest size.

11. The method of claim 10, further comprising:

selecting a second type of container from the at least two types of containers to receive a second subset of the plurality of merchandise items;

determining the second subset of the plurality of merchandise items to be received in the second selected type of container, each of the merchandise items in the second subset corresponding to the second selected type of container;

selecting a size of the second selected type of container to receive the second subset of the plurality of merchandise items; and instructing the disposition of the second subset of the plurality of merchandise items within the second selected type and size of container.

12. The method of claim 10, further comprising:

receiving an input set of flat bags, each flat bag having two dimensions;

calculating deformation of each flat bag to generate a set of deformable bags of different volumes for each flat bag, each deformable bag in the set having an associated volume; and selecting a deformable bag in the set to receive the first subset of the plurality of merchandise items.

13. The method of claim 10, wherein the deformable bags comprise at least one of polybags and jiffy bags.

14. The method of claim 10, wherein the first subset of the plurality of merchandise items are all a same type of merchandise item, the method further comprising:

selecting boxes as the container type and instructing creation of a customized box that form fits the first subset of the plurality of merchandise items.

15. The method of claim 10, further comprising:

receiving an indicator that a first merchandise item has a cavity defining a space therein;

determining that a second merchandise item has a size that is less than the space defined by the cavity; and instructing that the second merchandise item be disposed within the cavity.

16. The method of claim 10, further comprising:

receiving an indicator that a merchandise item is to be disposed in protective packaging occupying a predetermined amount of space;

calculating a new size of the merchandise item when disposed in the protective packaging; and instructing packing of the protectively packaged merchandise item in a container selected from the predetermined set of containers.

17. The method of claim 10, further comprising:

receiving an indicator that a merchandise item is to be arranged in a container in a predetermined orientation; and calculating a plurality of virtual packing arrangements in which the merchandise item is arranged in the container in the predetermined orientation; and selecting one of the plurality of the virtual packing arrangements.

* * * * *